US006536641B1

(12) United States Patent
Sundara et al.

(10) Patent No.: US 6,536,641 B1
(45) Date of Patent: Mar. 25, 2003

(54) BACK-MOUNTED LOAD-CARRYING APPARATUS

(75) Inventors: Chloe H. Sundara, Mill Valley, CA (US); John M. Williams, San Francisco, CA (US); Hans Wain, Truckee, CA (US); David Silva, San Francisco, CA (US); Jonathan Gray, Berkeley, CA (US)

(73) Assignee: Original Design Group, San Francisco, CA (US)

( * ) Notice: Subject to any disclaimer, the term of this patent is extended or adjusted under 35 U.S.C. 154(b) by 0 days.

(21) Appl. No.: 09/712,524

(22) Filed: Nov. 13, 2000

Related U.S. Application Data

(60) Provisional application No. 60/210,200, filed on Jun. 8, 2000.

(51) Int. Cl.[7] ..... A45F 3/04

(52) U.S. Cl. ..... 224/637; 224/631; 224/632; 224/634; 224/635; 224/641

(58) Field of Search ..... 224/628, 631, 224/632, 633, 634, 635, 636, 637, 641

(56) References Cited

U.S. PATENT DOCUMENTS

| | | | | | |
|---|---|---|---|---|---|
| 3,581,961 | A | * | 6/1971 | Owens | 224/262 |
| 3,774,824 | A | | 11/1973 | Hansson et al. | |
| 3,889,859 | A | * | 6/1975 | Joseph | 224/235 |
| 4,307,826 | A | * | 12/1981 | Stewart | 224/634 |
| 4,676,418 | A | * | 6/1987 | Lowe | 224/262 |
| 5,004,135 | A | * | 4/1991 | Dufournet et al. | 224/262 |
| 5,020,709 | A | | 6/1991 | Hoaglan | |
| 5,046,651 | A | | 9/1991 | Dagdagan | |
| 5,183,194 | A | | 2/1993 | Shirdavani | |
| 5,184,763 | A | | 2/1993 | Blaisdell et al. | |
| 5,284,279 | A | * | 2/1994 | Sason et al. | 224/632 |
| 5,419,473 | A | * | 5/1995 | Lamar | 206/315.3 |
| 5,429,287 | A | | 7/1995 | Frano | |
| 5,449,102 | A | * | 9/1995 | Sason | 224/632 |
| 5,609,279 | A | | 3/1997 | O'Shea | |
| 5,617,984 | A | | 4/1997 | Fabel | |
| 5,695,100 | A | | 12/1997 | O'Brien | |
| 5,725,139 | A | | 3/1998 | Smith | |
| 5,806,740 | A | | 9/1998 | Carlson | |
| 5,868,292 | A | | 2/1999 | Stephens et al. | |
| 5,878,928 | A | * | 3/1999 | Seiber | 224/153 |
| 5,934,529 | A | | 8/1999 | O'Brien | |
| 5,954,253 | A | | 9/1999 | Swetish | |
| 5,984,157 | A | | 11/1999 | Swetish | |
| 6,079,602 | A | | 6/2000 | Howell | |
| 6,199,732 | B1 | * | 3/2001 | Swetish | 224/262 |

* cited by examiner

*Primary Examiner*—Stephen K. Cronin
(74) *Attorney, Agent, or Firm*—Blakely, Sokoloff, Taylor & Zafman LLP

(57) ABSTRACT

A back-mounted load-carrying device, such as a backpack or a child carrier, having an adjustable waist belt assembly is described. The waist belt assembly is freely slidable between a variety of vertical positions along a rigid frame. A locking mechanism, actuatable while the device is being worn, permits a user to adjust the waist belt assembly to rest comfortably on his hip and around his waist on the fly and subsequently secure the waist belt in the desired position. A pair of hip-load transfer members that are rigid to loads applied in the vertical direction comprise the waist belt assembly and rest against the hip of a user when the waist belt is secured. These members help to transfer load from the device to the user's hips and act to lessen the amount of load carried by the user's shoulder and back, the result being greater comfort and less fatigue.

102 Claims, 12 Drawing Sheets

BACK-MOUNTED LOAD-CARRYING APPARATUS

CROSS-REFERENCE TO RELATED APPLICATION

The application claims priority of an earlier provisional application, Ser. No. 60/210,200 filed on Jun. 8, 2000.

COPYRIGHT NOTICE

Contained herein is material that is subject to copyright protection. The copyright owner has no objection to the facsimile reproduction of the patent disclosure by any person as it appears in the Patent and Trademark Office patent files or records, but otherwise reserves all rights to the copyright whatsoever.

FIELD OF THE INVENTION

The invention relates generally to a load-carrying apparatus that is designed to be worn on a user's back. More particularly, the invention relates to a back-mounted load-carrying apparatus incorporating an improved waist belt assembly.

BACKGROUND

Back-mounted load-carrying apparatuses such as backpacks and child carriers typically comprise shoulder straps which fit over the shoulders of a user and are the primary means of transferring the weight of the apparatus and its load to the user. Additionally, many packs incorporate hip or waist belts to insure the proper orientation of the apparatus while being carried as well as act to transfer a portion of the load to the users waist or hips. Load-carrying apparatuses that are designed to carry relatively large or heavy loads generally utilize a rigid frame to support the loads carried in the apparatus and help distribute the load on the user's back.

Ideally, with large or heavy loads, it would be desirable to transfer a significant amount of the load off of the user's shoulders and onto the user's waist or hips. Although current art backpacks and child carriers are capable of transferring some load to a user's hips, they are not particularly efficient or effective at doing so. They are typically not designed in a manner in which they may be effectively adjusted to accommodate users of different heights, and the design of the waist belt assembly is such that it is not capable of supporting significant loads.

Most waist belt assemblies are not vertically adjustable, being designed for an average person of a particular stature. Although the waist belt assembly may rest comfortably on the waist of the "average-sized" user, the waist belt assembly may rest above the hips of a taller-than-average person, and below the hips of a shorter-than-average person. The result is undue strain applied to the user's shoulder and back, resulting in user fatigue and/or back pain. Backpacks and child carriers are known that have adjustable waist belt assemblies, however they are often difficult to adjust precisely or quickly. The time required and complexity of adjusting the waist belt assembly inhibits the ability of one user of one height to quickly transfer a loaded, back-mounted load-carrying apparatus to another of a second height. For example, a husband and wife, both of average height for their gender, might desire to take turns carrying their child in a back-mounted child carrier, however to adjust the waist belt assembly for the other using current art child carriers the carrier would have to be put down, the child removed, the multiple straps, buckles and/or Velcro™ adjusted, and the child placed back in the carrier. The difficulty in adjusting the child carrier to differently-sized persons might act to discourage one parent from sharing the child-carrying duties. At the least, the difficulty to adjust back-mounted load-carrying devices discourages users from making adjustments and consequently, a user may use the apparatus in a less-than-optimum configuration, causing pain and premature fatigue.

Even if the waist belt assembly is properly adjusted to rest comfortably upon the user's hips, the design of current art waist belts prevents a significant amount of load to be transferred to the user's hips. Typically, the waist belts are made of fabric and webbing in conjunction with foam padding. These materials lack the rigidity to transfer the vertically-applied load to the user's hips. Furthermore, the waist belts are often attached to the flexible fabric structure of the load-carrying apparatus rather than directly to the rigid framework, further inhibiting load transfer. Accordingly, the waist belt assembly on most back-mounted load-carrying apparatuses acts to stabilize the load close to the user's back, but does not transfer any more than a small portion of the load to the user's hips.

SUMMARY OF THE INVENTION

A load-carrying apparatus for carrying load on the back of a user incorporating an improved waist belt assembly is described.

In one embodiment, the back-mounted load-carrying device such as, but not limited to, a child carrier or back pack, comprises a rigid frame, at least one shoulder strap to support the apparatus on the shoulder of a user, a device to restrain a load, and a waist belt assembly. The waist belt assembly includes a single, rigid, mounting bracket that is connected to the frame to allow the bracket to slide freely along a vertical axis of the frame. A waist belt to secure the pack to a user's waist is coupled to the mounting bracket.

In a second embodiment, the back-mounted load-carrying device also comprises a rigid frame, at least one shoulder strap to support the apparatus on the shoulder of a user, a device to restrain a load, and a waist belt assembly. The waist belt assembly includes a bracket connecting the waist belt assembly to the rigid frame, a waist belt coupled with the bracket, and a pair of hip-load transfer members. The hip-load transfer members are connected to the bracket by way of hinge mechanisms that permit rotation of the hip-load transfer members relative to the bracket. Furthermore, the hip-load transfer members are substantially rigid to loads applied in at least one direction.

BRIEF DESCRIPTION OF THE DRAWINGS

The present invention is illustrated by way of example and not by way of limitation in the accompanying figures briefly described below. Reference numerals within a figure refer to similar elements in the other figures unless otherwise noted.

DETAILED DESCRIPTION

Figure 1A:
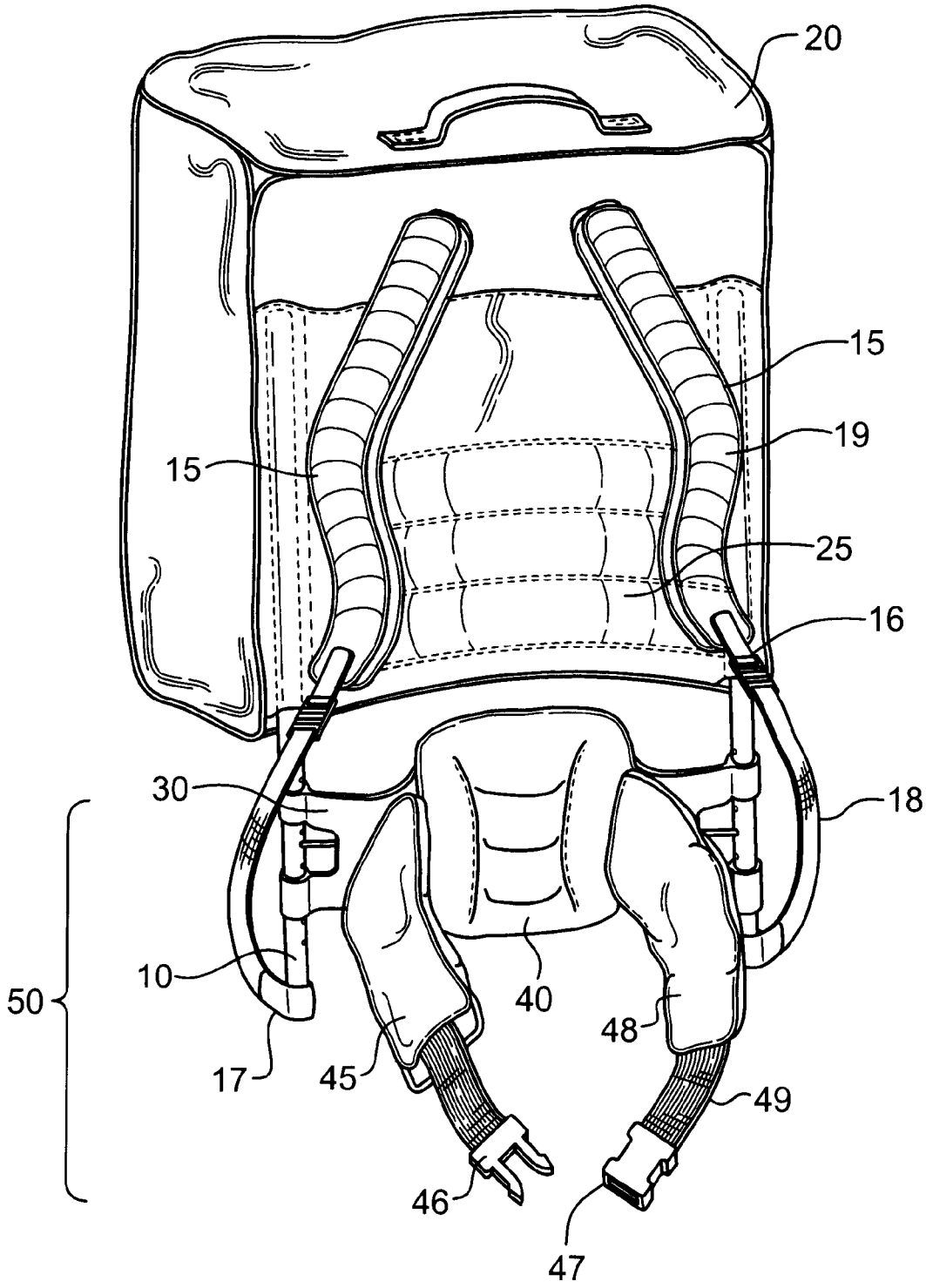
FIG. 1*a* is an illustration of a backpack embodiment of the present invention.

A load-carrying apparatus, such as a child carrier or a backpack, having an improved waist belt assembly is described. In the following description, for purposes of explanation, specific details are set forth in order to provide a thorough disclosure of the present invention. It will be apparent, however, to those skilled in the art that the present invention may be practiced without some of the specific details. Various modifications and changes may be made to the disclosed embodiments without departing from the broader spirit and scope of the invention. Accordingly, it is understood that the figures and accompanying description thereof are to be regarded as illustrative rather than restrictive, and that the scope of this invention is limited only by the claims presented below.

The exemplary embodiments described herein are in the form of a backpack and a child carrier. However, the invention is not limited to these embodiments, rather the present invention includes any back-mounted load-carrying device having the elements specified in the appended claims.

Embodiments of the load-carrying apparatus incorporate a waist belt assembly having a rigid mounting bracket that is slide-ably attached to the rigid frame of the apparatus, thereby permitting on-the-fly vertical adjustment of the waist belt relative to the rigid frame. In one version, a locking mechanism is incorporated into the waist belt assembly that secures the waist belt assembly in any one of a plurality of vertical positions along the rigid frame. In a preferred embodiment, the locking mechanism is actuatable by the user while the loaded pack is being worn upon his/her shoulders, allowing the user to freely move the waist belt assembly up or down to the correct location before securing the waist belt assembly in the correct location.

Other embodiments of the load-carrying apparatus incorporate a waist belt assembly having load-bearing members that protrude from a mounting bracket, adjacent to the waist belt padding, and are connected to the mounting bracket by way of hinges. Typically, the load-bearing plates comprise a solid material such as plastic, composite or metal that has sufficient rigidity in at least one direction to transfer load from the pack to the hips of the user. The hinges permit the load-bearing members to rotate when the waist belt is secured so that the load-bearing members rest, through the waist belt padding and fabric, against the waist of the user on top of the user's hip. Advantageously, load may be transferred from the frame to the mounting bracket through the hinges to the load-bearing members, and finally to the user's hip. In a preferred embodiment, the load-bearing members are plate-shaped in a generally vertical orientation such that the plates are flexible to horizontal loads and rigid to vertical loads. Advantageously, the plates may conform to the curve of a variety of users' waists to maximize the load transfer surface in contact with the users' hips. Ideally, the plates may be canted inward to maximize the surface area of the plates in contact with the upper portion of the user's hip.

FIG. 1*a* is an illustration of a preferred embodiment of a back-mounted load carrying apparatus in the form of a backpack. The backpack includes a rigid frame that supports a pack 20 and provides an interface with which padding 25, shoulder straps 15, and waist belt assemblies 50 may be attached. The particular rigid frame illustrated incorporates two vertically-orientated columnar members 10. Typically, as shown in FIG. 1, rigid frames are made of aluminum alloy tubes, although frames made of other materials and in other configurations are known. For instance, the columnar members 10 could be in the form of "L" or "C" channel fabricated from any number of metals, such as steel, aluminum and magnesium alloys, or polymeric-based materials, such as reinforced and un-reinforced plastics. Furthermore, a rigid frame could be in the form of a monocoque or space frame fabricated from a variety of materials.

Figure 1B:
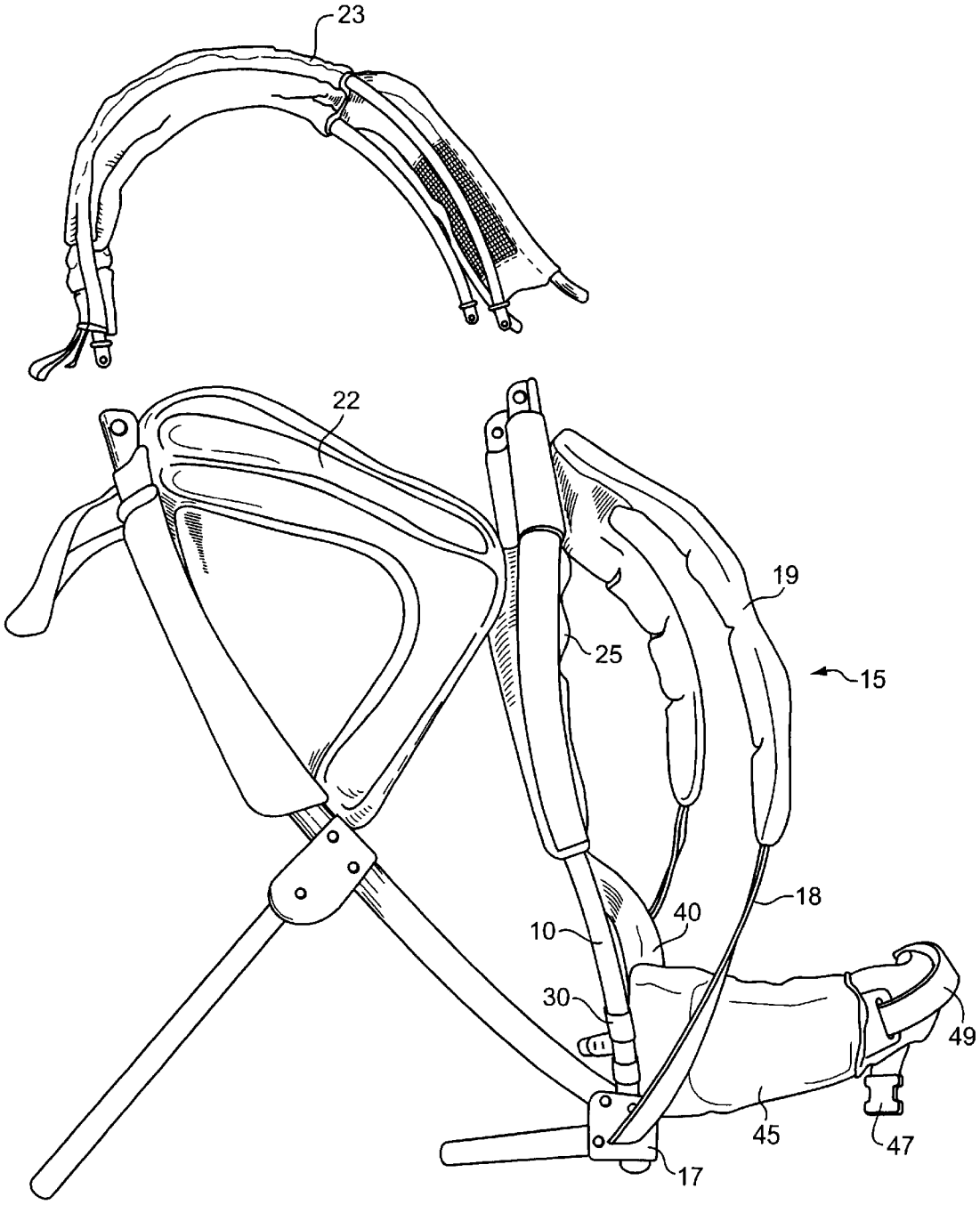
FIG. 1*b* is an illustration of a child carrier embodiment of the present invention.

The features discussed herein may be incorporated into other back-mounted load-carrying devices such as a child carrier as shown in FIG. 1*b*. In place of the pack 20 the child carrier has a cockpit 22 for restraining a child. In certain embodiments, the cockpit 22 may have attached thereto a canopy 23 that provides the child with wind and sun protection. Like the backpack, the child carrier includes a rigid frame that provides an interface with which padding 25, shoulder straps 15, and waist belt assemblies 50 may be attached. Unless otherwise indicated, the features discussed herein relative to the backpack of FIG. 1*a* are included in the child carrier embodiment of FIG. 1*b*.

Only a portion of the rigid frame of the backpack illustrated in FIG. 1*a* is visible. The remainder of the frame such as a horizontal cross bar to connect the columnar members 10 is covered by the pack 20 fabric. The exact configuration of the rigid frame relative to the load-restraining device, such as the illustrated pack 20 (i.e., whether the frame is external or internal to the pack 20), is not central to the present invention. Rather, it is contemplated that a wide variety of rigid frames may be utilized in practicing the invention.

Typically, the shoulder straps 15 are attached with the rigid frame at a top end, either directly or through an intermediate connection, with the pack 20. At a bottom end, the straps may be attached to the rigid frame via a bracket 17, or they may be attached to the pack 20. As shown in FIG. 1, most shoulder straps 15 will include a padded portion 19 that rests upon the user's shoulders and chest when the backpack is being carried and a strap portion 18 made of a webbing material looped through a buckle 16 permitting the length of the shoulder strap 15 to be adjusted for different size users.

Figure 1C:
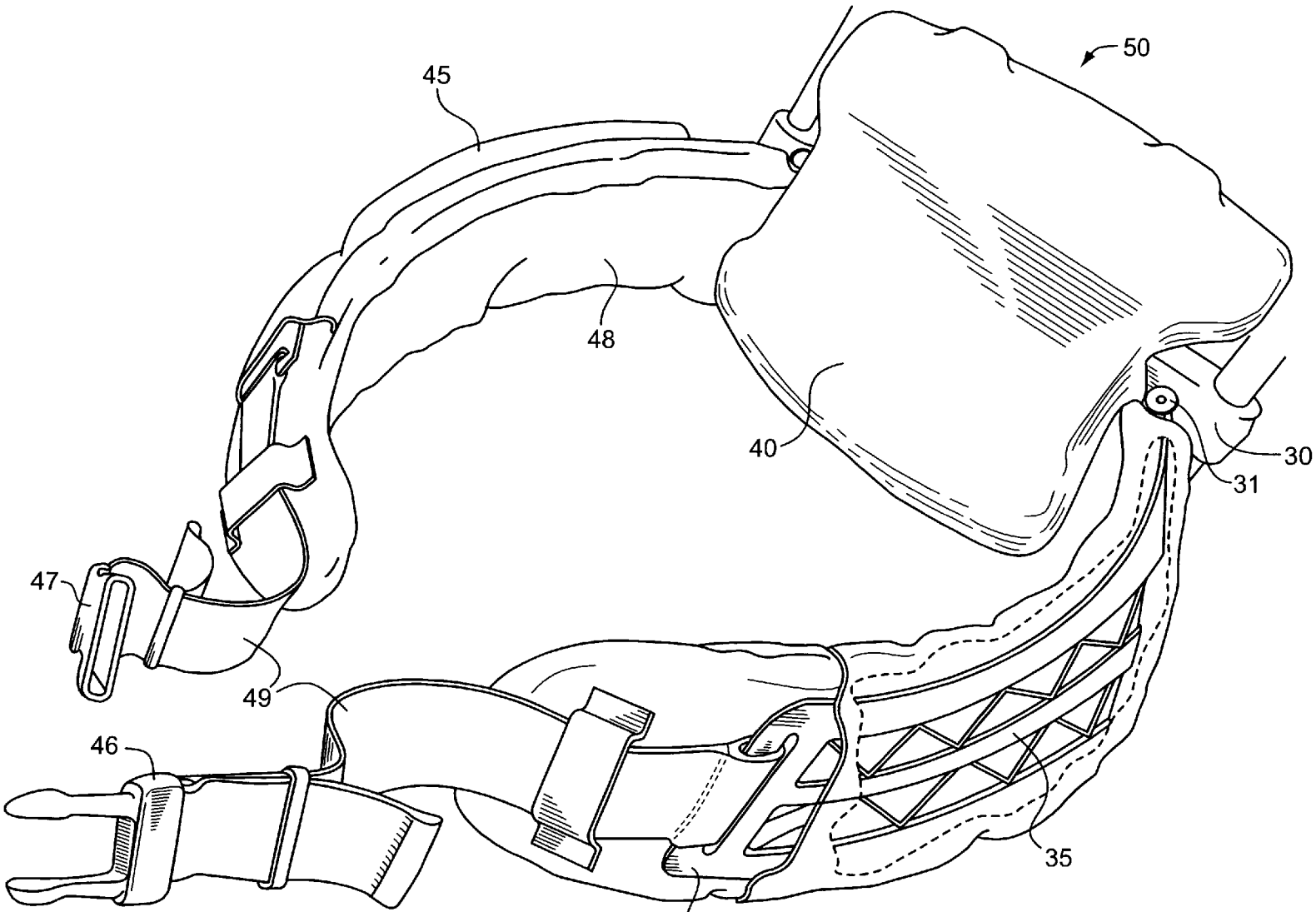
FIG. 1*c* is a front view illustration of a complete waist belt assembly as may be utilized according to the embodiments of the invention illustrated in FIGS. 1*a* and 1*b*.
Figure 2A:
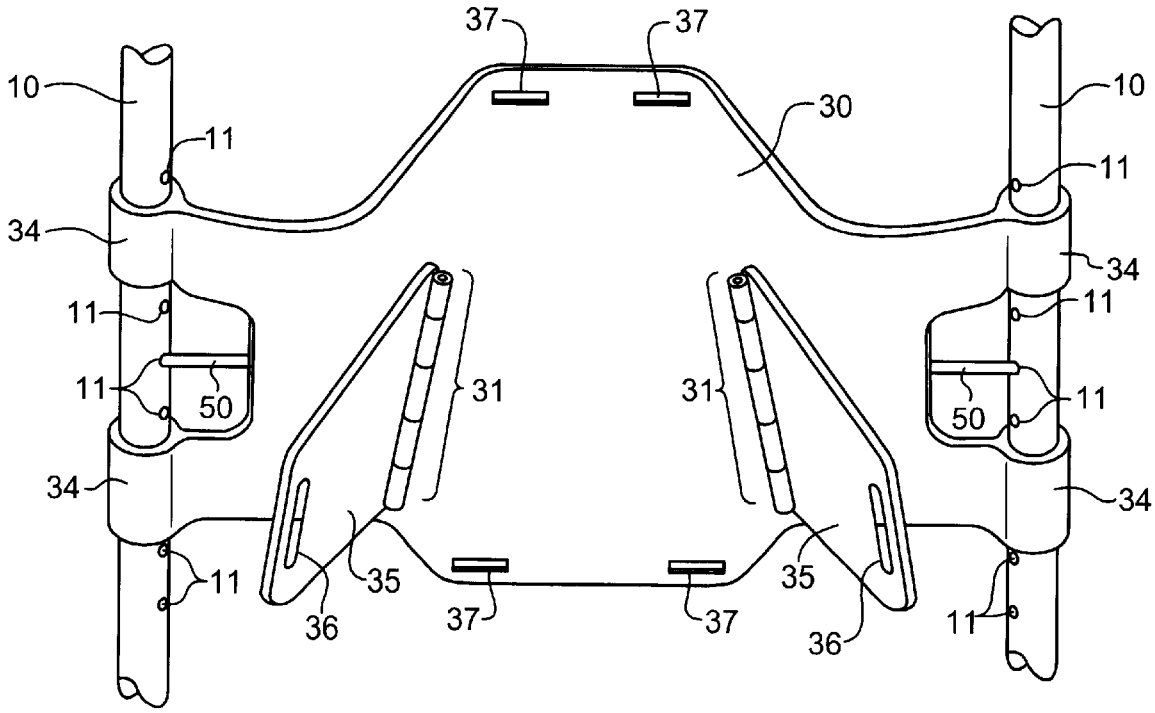
FIGS. 2*a*, 2*b* and 2*c* are front, rear and top views of a portion of an exemplary waist belt assembly.
Figure 2B:
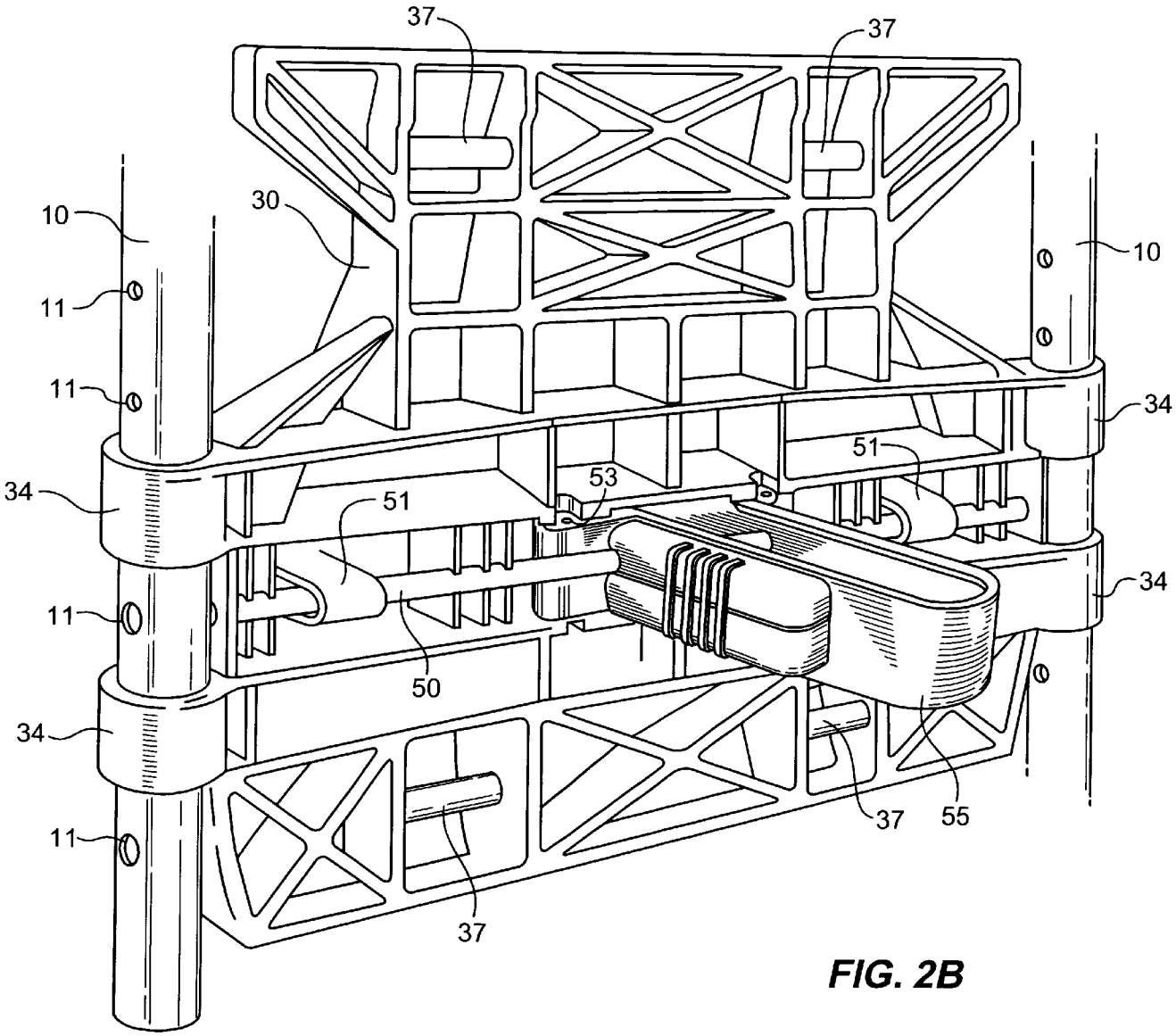
Figure 2C:
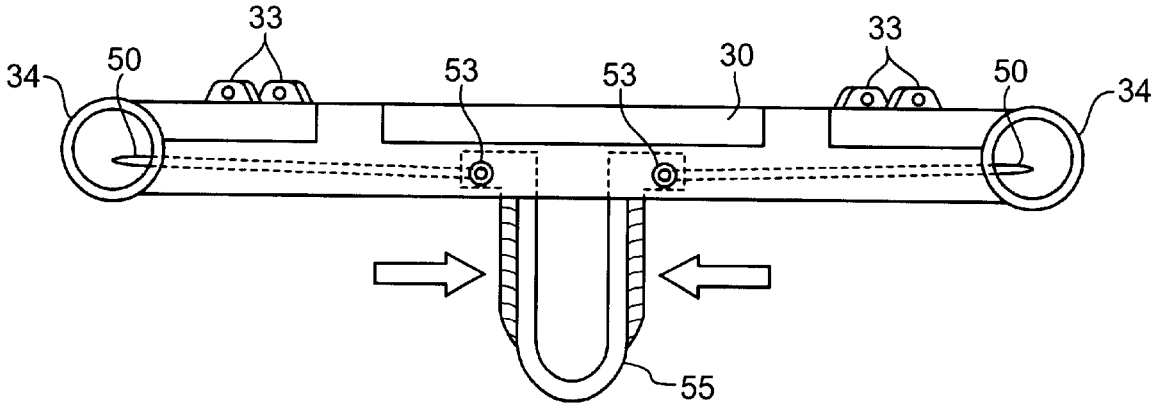

The waist belt assembly 50 is slide-ably attached to the columnar members 10 by way of a rigid mounting bracket 30. FIG. 1*c* is a front view illustration of a complete waist belt assembly as may be utilized in embodiments of the invention. FIGS. 2*a*, 2*b* and 2*c* further illustrate elements and components of the waist belt assembly 50. The rigid bracket 30 may be made of any suitable material, such as metal or composite, although in the preferred embodiment, the mounting bracket 30 is made of an injection molded plastic material. The mounting bracket 30 has formed thereon integral tubular receptacles 34 which are received on the tubular columnar members 10. This attachment configuration permits the bracket 30 to freely slide between a plurality of positions along the columnar members 10, which act as rails. Other rail-and-slide configurations are contemplated. For example, the mounting bracket 30 could have formed thereon protrusions that fit into an elongated slot on the columnar members 10, whereby the bracket may be slid up and down along the elongated slot.

The waist belt assembly 50 also includes a waist belt 45. The portion of the belt 45 that is adjacent the user's waist during use generally includes waist belt padding 48 to increase the comfort level of the user. The ends of the belt 45 terminate in a buckle or clip 46 and 47 that are attached to fabric webbing 49 in a manner that permits the length of the belt 45 to be adjusted for users of various waist sizes. The waist belt assembly further includes a lower back pad 40 that acts to support and cushion the back of a user. Typically, the padded and fabric portions of the waist belt assembly 50, such as the back pad 40 and padded portion 47 of the waist belt, are attached to the mounting bracket 30 via a loop and hook material (e.g., Velcro™) or straps and buckles through slots 37 in the mounting bracket.

Figure 3:
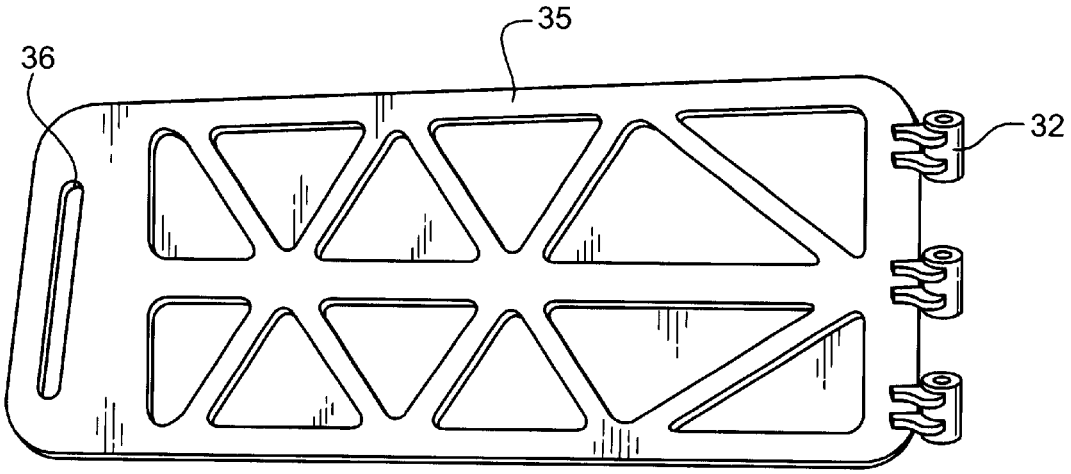
FIG. 3 is an illustration of a planar hip-load transfer member according to one embodiment of the invention.

In the preferred embodiment, the waist belt 45 also comprises a pair of hip load-transfer plates 35 attached to the mounting bracket 30 by way of hinges 31 that permit the plates 35 to rotate about the axis of each hinge 31. The hinges 31 will often comprise hinge pin receptacles 32 and 33 located on both the mounting bracket 30 and the load-transfer plates 35. A typical hip load-transfer plate is illustrated in FIG. 3. As illustrated in FIGS. 1*a*, 1*b* and 1*c*, the plate 35 may be hidden from view and contained within a pocket formed within the fabric of the waist belt padding 48. Each plate 35 includes a slot 36 on the end of the plate opposite the hinge pin receptacles 32, through which one end of the fabric webbing 49 may be attached to the assembly, securing the webbing 49 to the waist belt assembly 50, and operatively integrating the plates into the waist belt 45.

Generally, the plates will be in operative connection with the waist belt so that securing the waist belt to the waist of a user brings the plates 35 in contact with the user's hips. However, in alternative embodiments, the plates 35 may not be an integral part of the waist belt itself. Rather, the waist belt webbing 49 may be attached to the mounting bracket 30 and/or the fabric of the waist belt padding 48 and the plates 35 may be operatively connected to the waist belt 45 by any number of means including, but not limited to, attaching the plates 35 to the waist belt padding 48 or webbing 49 by way of rivets, adhesive, Velcro™ or stitching.

The plates 35 are fabricated from a generally rigid material such as solid plastic or metal and are configured so that they resist deflection from loads applied in a generally vertical direction, such as the weight of the backpack when loaded. Additionally, the plates 35 are flexible and/or resilient to generally horizontal loads such as those that would be applied when buckling the waist belt to a user. Accordingly, the plates 35 conform to the curve of the user's waist when the waist belt 45 is buckled, thus maximizing the contact between the plate 35 and the user's hip through the waist belt padding 48. In the preferred embodiment, the plates 35 are orientated on the mounting bracket 30 such that they cant inward off of vertical anywhere from 0 to 45 degrees with approximately 25 degrees being optimal. The cant permits a greater area of the plates 35 to rest against the user's hip and more effectively and evenly transfer the load to the user's hips.

In alternative embodiment back-mounted load-carrying devices, the hip load-transfer members may consist of other shapes or configurations provided they possess the necessary rigidity in the vertical direction to transfer load to the user's hips. For example, the hip-load transfer members could have a cylindrical or semi-cylindrical cross section. Rather than exhibiting flexibility to horizontal loads, the load transfer members could have an arcuate shape that approximates the shape of a user's waist, such that when the waist belt is secured, a greater portion of the member is resting on the user's hip. Additionally, the hip load transfer members may be attached to the mounting bracket by any means that facilitates the transfer of load from the pack to the load-transfer member and finally to the user's hip and waist. For instance, a living hinge could be utilized. Other variations of the hip-load transfer members are also contemplated as would be within the full scope of the appended claims.

Figure 4:
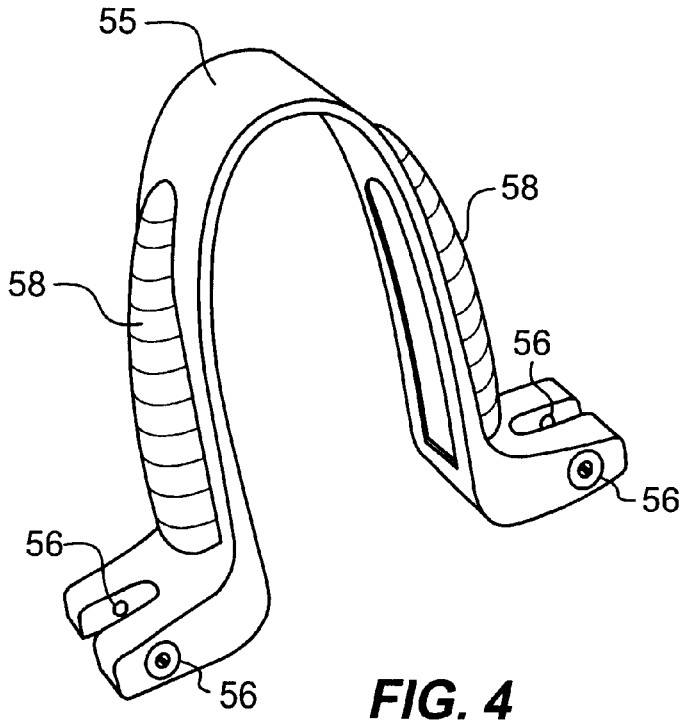
FIG. 4 is an illustration of an actuator utilized in a locking mechanism according to one embodiment of the invention.
Figure 5:
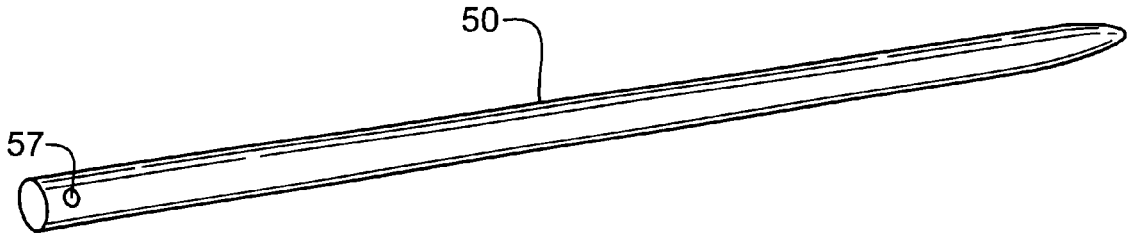
FIG. 5 is an illustration of a shaft utilized in the locking mechanism according to one embodiment of the invention.

A locking mechanism is provided to secure the mounting bracket 30 at selected positions along the columnar members 10. The preferred embodiment locking mechanism comprises an actuator 55 attached to two horizontally opposed shafts 50, the shafts 50 being contained by guides 51 attached or integrally molded into the mounting bracket 30. The locking mechanism is illustrated in FIGS. 2*b* and 2*c*, the actuator 50 is illustrated in FIG. 4 and the shaft in FIG. 5.

The various vertical positions along the columnar members 10 are defined by openings or holes 11 spaced in the columnar members 10. In a locked position, each shaft 50 is engaged in one of the holes 11 preventing up or down movement of the mounting bracket 30. The shafts 50 are normally biased in the engaged position, and are moveable within the guides 51 to a disengaged position by depressing the U-shaped actuator 55 as indicated by the arrows in FIG. 2*c* to pull the shafts 50 out of the holes 11. Each shaft 50 is attached to the actuator 55 by way of a small cotter pin 53 that is engaged in openings 56 & 57 in the ends of the actuator 55 and in the shaft 50.

The actuator 55 is preferably made from a molded plastic, however other materials are contemplated such as metal, a combination of metal and plastic, and composite. The actuator 55 has to handle surfaces 58 through which a user may press the sides of the U-shaped actuator 55 towards each other using a single hand to overcome the spring force applied by the U-shaped actuator 55, and pull the shafts 50 out of the holes 11. While compressing the sides of the actuator 55 after disengaging the shafts 50, the user may freely slide the waist belt assembly 50 along the columnar members 10 into a desired position using the same hand with the actuator 55 serving as a handle. Once the desired position is located, the user may release the actuator 55 causing the actuator 55 to apply a biasing force to the shafts 50 and encourage the shafts into the nearest holes 11 on the columnar members 10 to relock the waist belt assembly 50 in place. The design of the locking mechanism and the dual functionality of the actuator 55 permits the waist belt assembly 50 to be easily adjusted with a single hand even when the pack is suspended on the back of the user by the shoulder straps 15. A number of variations of the preferred embodiment locking mechanism are contemplated. For example, the shafts 50 could be biased in the disengaged position instead of the engaged position, or a rotatable knob connected with a torsion spring could be used in place of the U-shaped actuator 55.

The scope of the present invention is not intended to be limited by the specific type of locking mechanism utilized to lock the waist belt assembly 50 in place relative to the rigid frame. FIGS. 6–10 illustrate several alternative locking mechanisms suitable for use in conjunction with a back-mounted load-carrying apparatus having spaced vertically-orientated columnar members 10. In each of these illustrations, the remainder of the waist belt assembly 50 is deleted for convenience, although in practice each would include other essential components. It is to be noted, however, that other types of locking mechanisms in conjunction with other mounting bracket designs are contemplated for use with rigid frames not having two spaced columnar members that are within the scope of the appended claims.

Figure 6:
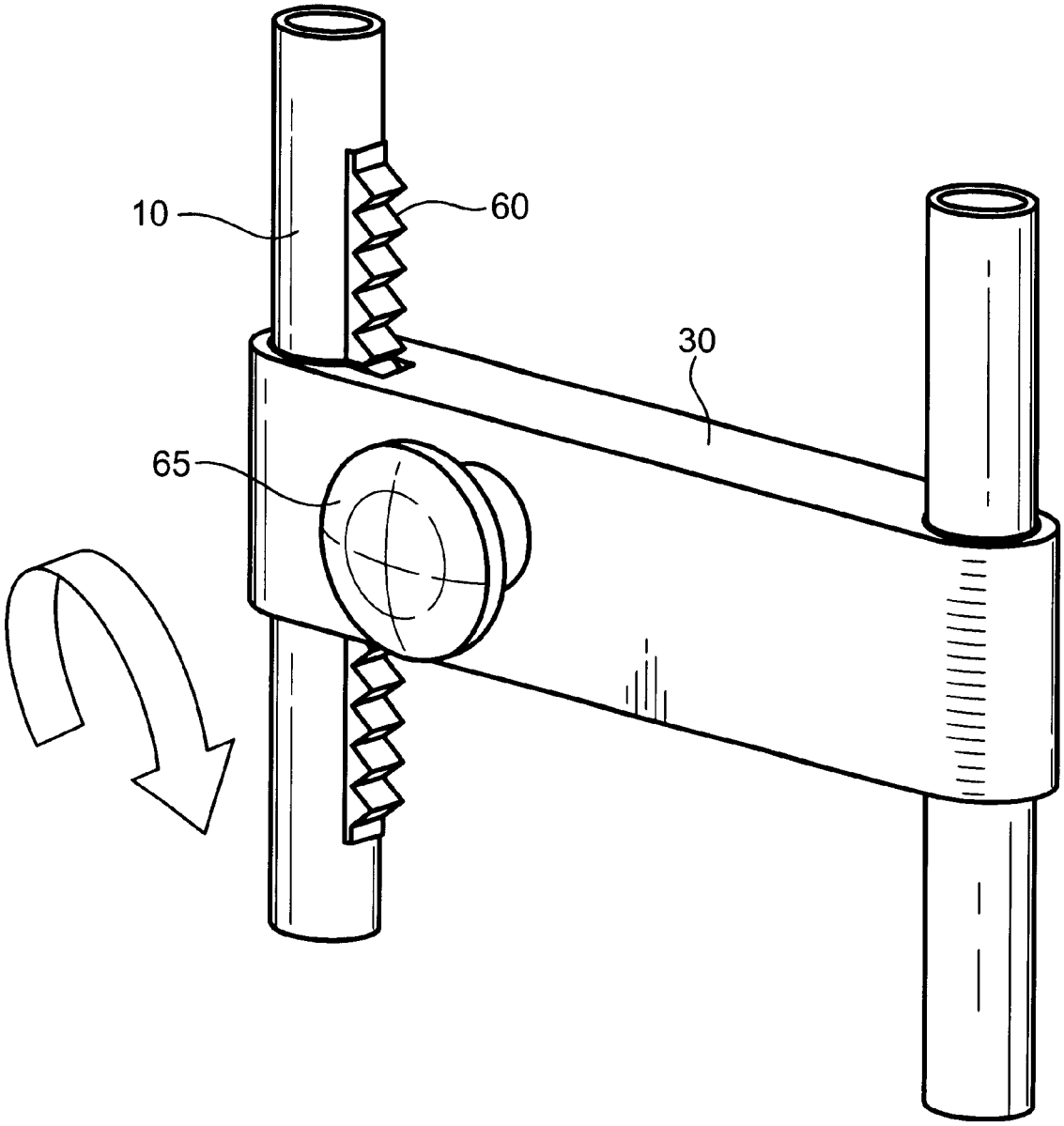
FIGS. 6, 7, 8, 9 and 10 are illustrations of waist belt assembly mounting brackets incorporating various locking mechanisms according to alternative embodiments of the invention.

FIG. 6 illustrates a geared locking mechanism that serves the dual purpose of moving the mounting bracket 30 up and down along the columnar members 10. The mechanism includes a linear set of gear teeth 60 attached to one columnar member 10. A toothed gear (not shown) meshes with the linear gear teeth 15 and is attached via a shaft to knob 65. By rotating the knob either clockwise or counterclockwise, the waist belt assembly can be moved vertically relative to the rigid frame. This locking mechanism, like the preferred locking mechanism, allows operation by a user with a single hand while wearing the load-carrying apparatus.

Figure 7:
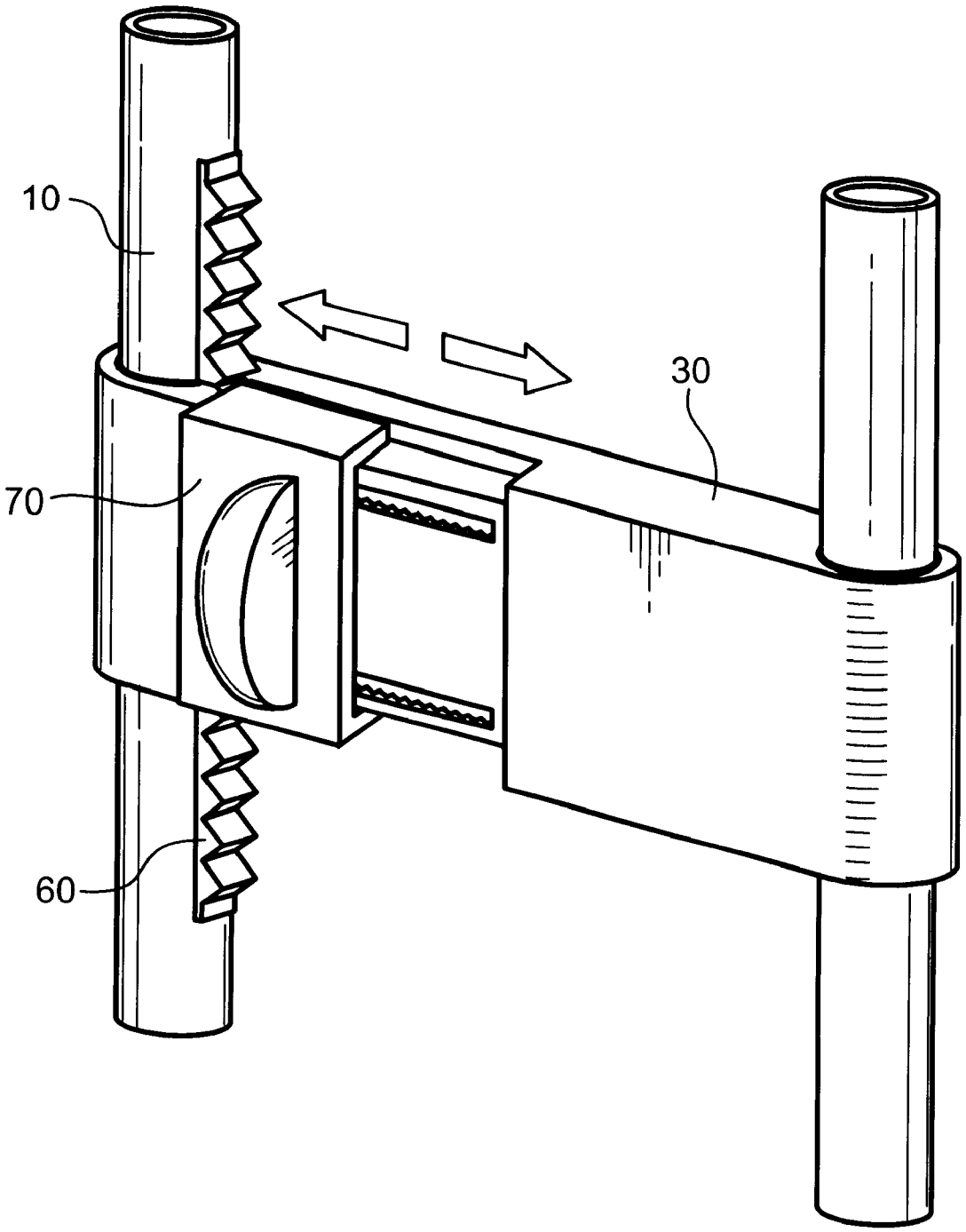

FIG. 7 illustrates another locking mechanism utilizing a linear set of gear teeth 60 attached to the columnar member 10. The mechanism utilizes a slide handle 70 connected with the mounting bracket 30. The slide handle 70 has a set of linear gear teeth (not shown) connected to the backside of the slide handle 70 that are opposed to and mesh with the linear gear teeth 60. The slide handle and the slide handle gear teeth are biased against the linear gear teeth by a spring member (not shown) to lock the waist belt assembly in place. By sliding the slide handle 70 away from the linear gear teeth 60, the mounting bracket and waist belt assembly are freed to moved along the columnar members 10. This design is also operable using a single hand of the user while the user is wearing the load-carrying assembly.

Figure 8:
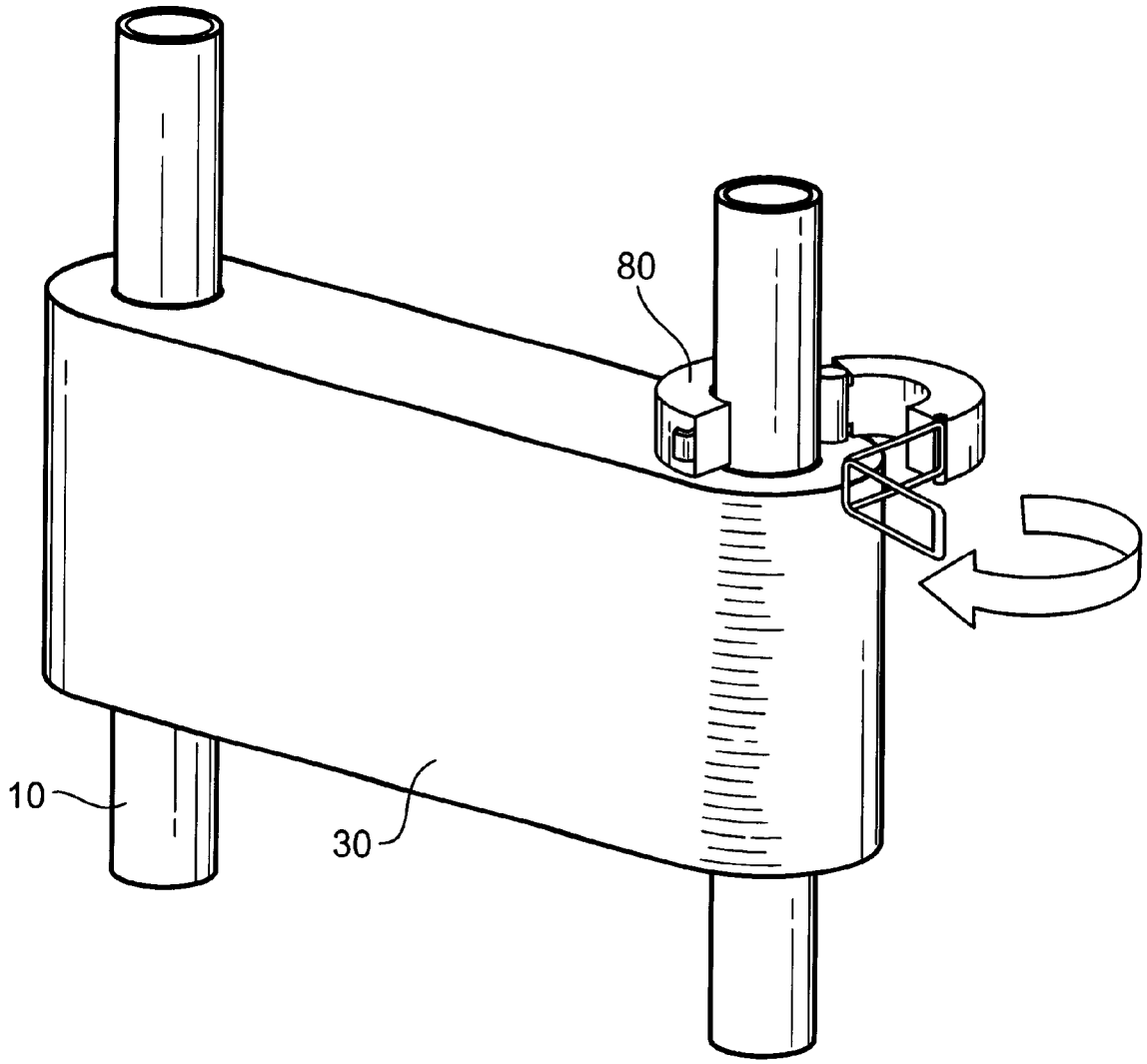

FIG. 8 illustrates a locking mechanism using a locking cuff 80 attached to the mounting bracket 30 to secure the waist belt assembly in place. By flipping a lever, the locking cuff 80 is released to permit the mounting bracket 30 to slide along the columnar members 10. Once the desired location is determined, the lever is re-engaged to apply a compression force to the columnar member 10 and hold the waist belt assembly in place.

Figure 9:
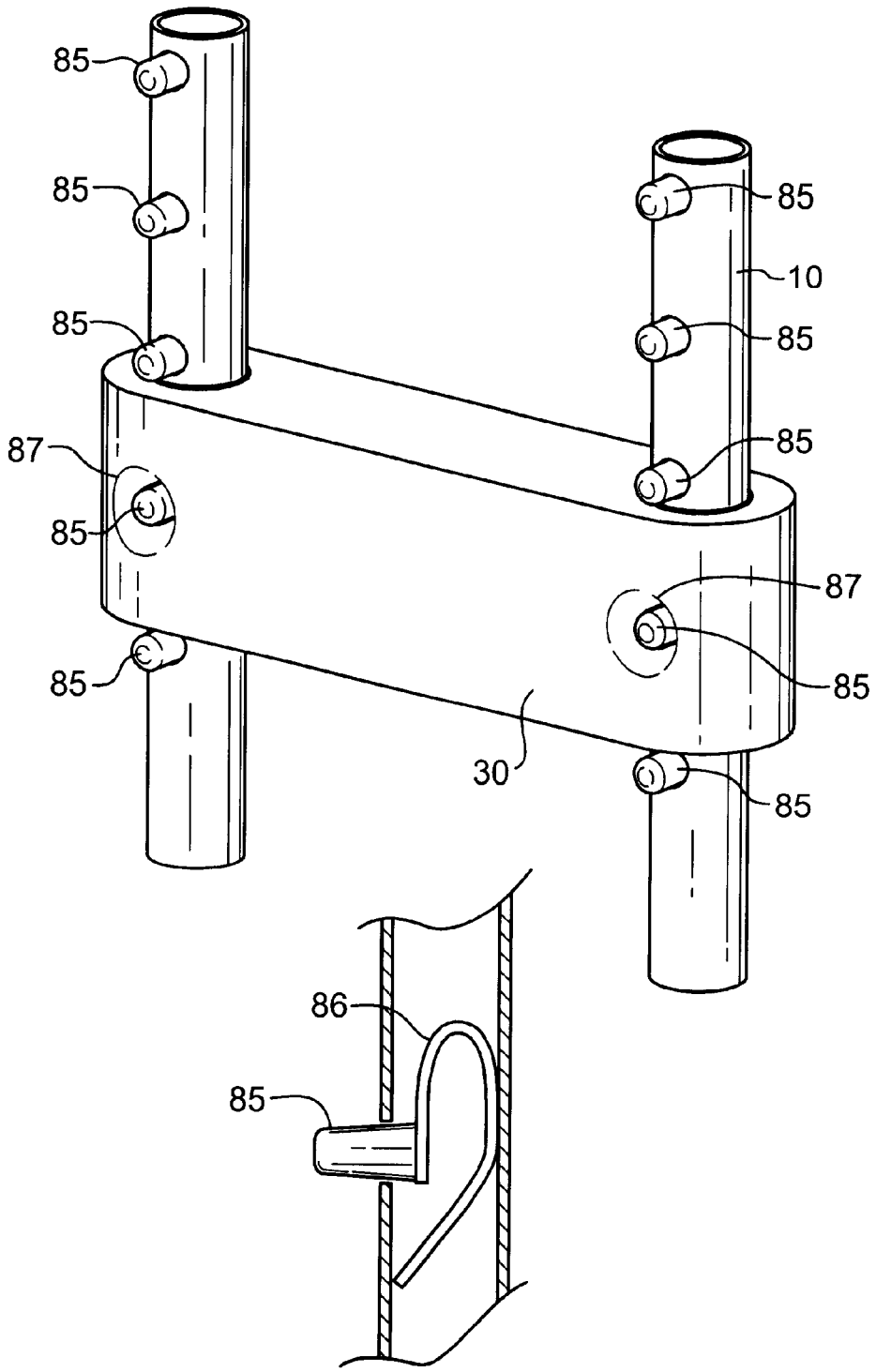

FIG. 9 illustrates a locking mechanism which utilizes pins 85 contained within tubular columnar members 10 and is biased outward through holes in the columnar members 10 by steel springs 86. The mounting bracket 30 has openings 87 so located and sized to receive the pins 85 and lock the waist belt assembly in place. To adjust the waist belt assembly, a user simultaneously pushes the pins 85 into the tubular columnar members 10 to disengage the pins 85 from the mounting bracket holes 87 and slides the bracket 30 up or down as desired.

Figure 10:
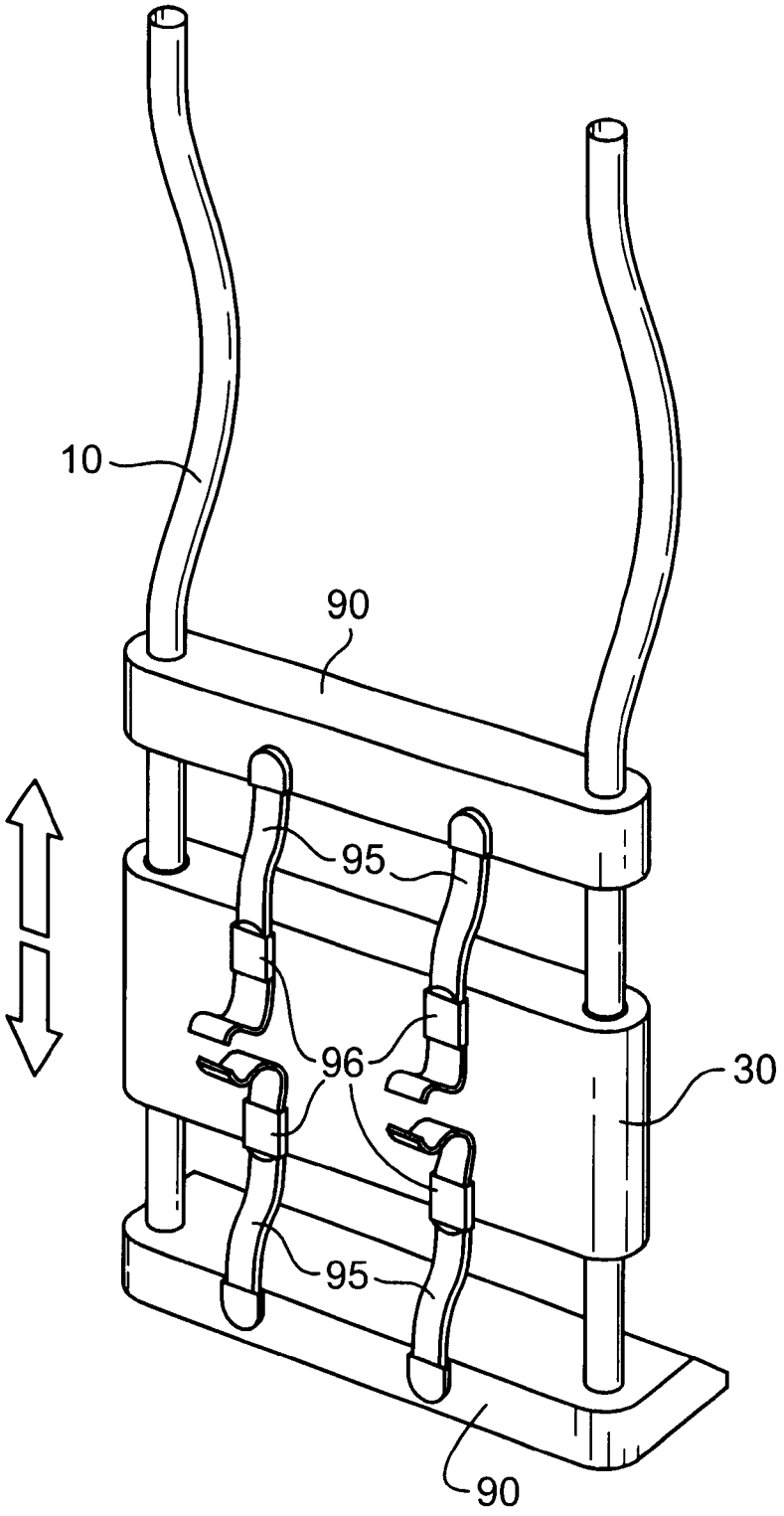

FIG. 10 depicts a locking mechanism that uses webbing straps 95 to lock the mounting bracket 30 in place. Webbing straps 95 are secured to horizontal cross members 90 located above and below the mounting bracket 30. Buckles, cam locks or Velcro™ material 96 is placed on the sliding mounting bracket 30 to secure the webbing straps 95. By releasing the buckles, the mounting bracket 30 can be freely slid along the columnar members 10 of the rigid frame to the desired position. The buckles are then re-tightened, and opposing upper and lower webbing straps 95 prevent the vertical movement of the mounting bracket 30.

We claim:

1. A back-mounted load-carrying apparatus comprising:

a rigid frame, the rigid frame including two spaced substantially parallel columnar members, at least one columnar member having a plurality of openings formed therein;

two shoulder straps;

a load restraining device, the load restraining device configured to secure a load to the back-mounted load carrying apparatus; and a waist belt assembly, the waist belt assembly comprising, i) a rigid mounting bracket spanning the space between the two columnar members, the rigid mounting bracket being connected to the two columnar members to permit generally vertical movement of the rigid mounting bracket along the columnar members, ii) a belt and buckle configuration, the belt and buckle configuration attached with the rigid mounting bracket.

2. The back-mounted load-carrying apparatus of claim 1, wherein the columnar members are tubular.

3. The back-mounted load-carrying apparatus of claim 1, wherein the waist belt assembly further comprises:

a locking mechanism attached to the rigid mounting bracket, the locking mechanism including, i) at least one shaft which is moveable between an extended position and a retracted position, and ii) a shaft actuator connected to the at least one shaft, the shaft actuator being operable by a user to move the at least one shaft between the extended and retracted positions, wherein the at least one shaft may be received into one of the plurality of openings when in the extended position.

4. The back-mounted load-carrying apparatus of claim 3, wherein the shaft actuator may actuated by a single hand of the user to move the shaft between the extended and retracted positions.

5. The back-mounted load-carrying apparatus of claim 3, wherein the waist belt assembly further comprises:

(a) a pair of hip-load transfer members that are substantially rigid in a generally vertical direction; and (b) a pair of hinges, each hinge of the pair of hinges rotate-ably connecting the pair of hip-load transfer members to the rigid bracket.

6. The back-mounted load-carrying apparatus of claim 5, wherein the hip-load transfer members are plates, the plates each having a face wherein the plates are flexible to loads applied to the face.

7. A back-mounted load-carrying apparatus comprising:

(a) a rigid frame;

(b) at least one shoulder strap;

(c) a load restraining device, the load-restraining device configured to secure a load to the back-mounted load-carrying apparatus; and (d) a waist belt assembly, the waist belt assembly including i) a single rigid mounting bracket connected to the rigid frame to permit the rigid mounting bracket to be adjusted vertically along at least a portion of the rigid frame, and ii) a waist belt coupled to the rigid mounting bracket, the waist belt including two hip load transfer plates and two hinges, each hinge of the two hinges rotate-ably attaching one of the two hip load transfer plates to the rigid mounting bracket.

8. The back-mounted load-carrying apparatus of claim 7, wherein the load-restraining device is a pack.

9. The back-mounted load-carrying apparatus of claim 7, wherein the load-restraining device is a cockpit to support and restrain a child.

10. The back-mounted load-carrying apparatus of claim 7, wherein the rigid mounting bracket has a first surface facing the back of a user when the back-mounted load-carry apparatus is carried in its preferred position, the first surface being covered at least partially with padding.

11. The back-mounted load-carrying apparatus of claim 7, wherein the rigid mounting bracket is fabricated of a plastic material.

12. The back-mounted load-carrying apparatus of claim 7, wherein the waist belt assembly further comprises a locking mechanism to lock the waist belt assembly to the rigid frame at one of a plurality of positions.

13. The back-mounted load-carrying apparatus of claim 12, wherein the locking mechanism is attached to the rigid mounting bracket.

14. The back-mounted load-carrying apparatus of claim 12, wherein the locking mechanism is operable by a user to lock and unlock the waist belt assembly while the user is wearing the back-mounted load-carrying apparatus in the intended manner.

15. The back-mounted load-carrying apparatus of claim 14, wherein the locking mechanism is operable using a single hand of the user while the user is wearing the back-mounted load-carrying apparatus in the intended manner.

16. The back-mounted load-carrying apparatus of claim 15, wherein the waist belt assembly may be further freely moved between the plurality of positions using the single hand of the user when the locking mechanism is unlocked and while the user is wearing the back-mounted load-carrying apparatus in the intended manner.

17. The back-mounted load-carrying apparatus of claim 7, wherein the rigid frame comprises at least one columnar member, the columnar member being substantially vertically orientated when a user is carrying the back-mounted load carrying apparatus in an intended manner.

18. The back-mounted load-carrying apparatus of claim 17, wherein the at least one columnar member is tubular.

19. The back-mounted load-carrying apparatus of claim 17, wherein:

(a) the locking mechanism comprises at least one shaft, movable from an extended position and a retracted position;

(b) the at least one columnar member has formed therein a plurality of openings, each of the plurality of openings capable of receiving the at least one shaft when the shaft is in a extended position.

20. The back-mounted load-carrying apparatus of claim 19, wherein the at least one shaft is biased in the extended position.

21. The back-mounted load-carrying apparatus of claim 19, wherein the locking mechanism further includes a biasing mechanism connected with the at least one shaft to encourage the shaft into the extended position.

22. The back-mounted load-carrying apparatus of claim 21, wherein:

the biasing mechanism comprises a U-shaped spring member, having a bottom portion located at the curve of the U-shape, a left and right portion, each intersecting with the bottom portion of the u-shape and each having an open end; and the at least one shaft is coupled to the right or left portion of the u-shaped spring member near or substantially at the open end of the right or left portion;

whereby a user may depress the u-shaped spring member on the right and left portions to pull the at lease one shaft into the retracted position, freeing the rigid mounting bracket to slide along the rigid frame.

23. The back-mounted load-carrying apparatus of claim 21, wherein:

the biasing mechanism is comprises, i) a knob rotate-ably connected to the rigid mounting bracket and, ii) a torsion spring with two ends, one end restrained at a first connection location on the rigid mounting bracket, and the other end restrained at a second connection location on the knob;

the at least one shaft is coupled with the knob;

whereby the knob may be rotated by a user to pull the at lease one shaft into the retracted position, freeing the rigid mounting bracket to slide along the rigid frame.

24. The back-mounted load-carrying apparatus of claim 7, wherein:

the hip-load transfer plates are substantially rigid to loads applied in a first direction and substantially resilient to loads applied in a second direction, the second direction being approximately perpendicular to the first direction; and whereby when the back-mounted load carrying apparatus is worn and the waist belt secured, the plates approximately conform to a user's body and act to transfer at least a portion of the weight of the back-mounted load carrying apparatus to the user's hips.

25. The back-mounted load-carrying apparatus of claim 24, wherein the hip-load transfer plates are substantially vertically orientated.

26. The back-mounted load-carrying apparatus of claim 24, wherein the hip-load transfer plates are canted relative to a vertical axis of the back-mounted load-carrying apparatus.

27. The back-mounted load-carrying apparatus of claim 26, wherein the hip-load transfer plates are canted inward towards each other.

28. The back-mounted load-carrying apparatus of claim 7, wherein the two hinges comprise living hinges.

29. A back-mounted load-carrying apparatus comprising:

(e) a rigid frame;

(f) at least one shoulder strap;

(g) a load restraining device, the load-restraining device configured to secure a load to the back-mounted load-carrying apparatus; and (h) a waist belt assembly, the waist belt assembly including i) a single rigid mounting bracket connected to the rigid frame to permit the rigid mounting bracket to be adjusted vertically along at least a portion of the rigid frame, the rigid frame comprising at least one tubular columnar member, the columnar member being substantially vertically orientated when a user is carrying the back-mounted load carrying apparatus in an intended manner, and ii) a waist belt coupled to the rigid mounting bracket.

30. The back-mounted load-carrying apparatus of claim 29, wherein the load-restraining device is a pack.

31. The back-mounted load-carrying apparatus of claim 29, wherein the load-restraining device is a cockpit to support and restrain a child.

32. The back-mounted load-carrying apparatus of claim 29, wherein the rigid mounting bracket has a first surface facing the back of a user when the back-mounted load-carry apparatus is carried in its preferred position, the first surface being covered at least partially with padding.

33. The back-mounted load-carrying apparatus of claim 29, wherein the rigid mounting bracket is fabricated of a plastic material.

34. The back-mounted load-carrying apparatus of claim 29, wherein the waist belt assembly further comprises a locking mechanism to lock the waist belt assembly to the rigid frame at one of a plurality of positions.

35. The back-mounted load-carrying apparatus of claim 34, wherein the locking mechanism is operable by a user to lock and unlock the waist belt assembly while the user is wearing the back-mounted load-carrying apparatus in the intended manner.

36. The back-mounted load-carrying apparatus of claim 35, wherein the locking mechanism is operable using a single hand of the user while the user is wearing the back-mounted load-carrying apparatus in the intended manner.

37. The back-mounted load-carrying apparatus of claim 36, wherein the waist belt assembly may be further freely moved between the plurality of positions using the single hand of the user when the locking mechanism is unlocked and while the user is wearing the back-mounted load-carrying apparatus in the intended manner.

38. The back-mounted load-carrying apparatus of claim 34, wherein the locking mechanism is attached to the rigid mounting bracket.

39. The back-mounted load-carrying apparatus of claim 38, wherein:

(a) the locking mechanism comprises at least one shaft, movable from an extended position and a retracted position;

(b) the at least one columnar member has formed therein a plurality of openings, each of the plurality of openings capable of receiving the at least one shaft when the shaft is in a extended position.

40. The back-mounted load-carrying apparatus of claim 39, wherein the at least one shaft is biased in the extended position.

41. The back-mounted load-carrying apparatus of claim 39, wherein the locking mechanism further includes a biasing mechanism connected with the at least one shaft to encourage the shaft into the extended position.

42. The back-mounted load-carrying apparatus of claim 41, wherein:

the biasing mechanism comprises a U-shaped spring member, having a bottom portion located at the curve of the U-shape, a left and right portion, each intersecting with the bottom portion of the u-shape and each having an open end; and the at least one shaft is coupled to the right or left portion of the u-shaped spring member near or substantially at the open end of the right or left portion;

whereby a user may depress the u-shaped spring member on the right and left portions to pull the at lease one shaft into the retracted position, freeing the rigid mounting bracket to slide along the rigid frame.

43. The back-mounted load-carrying apparatus of claim 41, wherein:

the biasing mechanism is comprises, iii) a knob rotate-ably connected to the rigid mounting bracket and, iv) a torsion spring with two ends, one end restrained at a first connection location on the rigid mounting bracket, and the other end restrained at a second connection location on the knob;

the at least one shaft is coupled with the knob;

whereby the knob may be rotated by a user to pull the at lease one shaft into the retracted position, freeing the rigid mounting bracket to slide along the rigid frame.

44. The back-mounted load-carrying apparatus of claim 29, wherein the waist belt further includes two hip load transfer plates and two hinges, each hinge of the two hinges rotate-ably attaching one of the two hip load transfer plates to the rigid mounting bracket.

45. The back-mounted load-carrying apparatus of claim 44, wherein the two hinges comprise living hinges.

46. The back-mounted load-carrying apparatus of claim 44, wherein:

the hip-load transfer plates are substantially rigid to loads applied in a first direction and substantially resilient to loads applied in a second direction, the second direction being approximately perpendicular to the first direction; and whereby when the back-mounted load carrying apparatus is worn and the waist belt secured, the plates approximately conform to a user's body and act to transfer at least a portion of the weight of the back-mounted load carrying apparatus to the user's hips.

47. The back-mounted load-carrying apparatus of claim 46, wherein the hip-load transfer plates are substantially vertically orientated.

48. The back-mounted load-carrying apparatus of claim 46, wherein the hip-load transfer plates are canted relative to a vertical axis of the back-mounted load-carrying apparatus.

49. The back-mounted load-carrying apparatus of claim 48, wherein the hip-load transfer plates are canted inward towards each other.

50. A back-mounted load-carrying apparatus comprising:

(i) a rigid frame;

(j) at least one shoulder strap;

(k) a load restraining device, the load-restraining device configured to secure a load to the back-mounted load-carrying apparatus; and (l) a waist belt assembly, the waist belt assembly including i) a single rigid mounting bracket connected to the rigid frame to permit the rigid mounting bracket to be adjusted vertically along at least a portion of the rigid frame, ii.) a locking mechanism attached to the rigid mounting bracket to lock the waist belt assembly to the rigid frame at one of a plurality of position, the locking mechanism comprising at least one shaft movable from an extended position and a retracted position, the at least one columnar-member has formed therein a plurality of openings, each of the plurality of openings capable of receiving the at least one shaft when the shaft is in a extended position, the locking mechanism further comprising a biasing mechanism connected with the at least one shaft to encourage the shaft into the extended position wherein the biasing mechanism comprises a U-shaped spring member, having a bottom portion located at the curve of the U-shape, a left and right portion, each intersecting with the bottom portion of the u-shape and each having an open end, and wherein the at least one shaft is coupled to the right or left portion of the u-shaped spring member near or substantially at the open end of the right or left portion, whereby a user may depress the u-shaped spring member on the right and left portions to pull the at lease one shaft into the retracted position, freeing the rigid mounting bracket to slide along the rigid frame, and iii.) a waist belt coupled to the rigid mounting bracket.

51. The back-mounted load-carrying apparatus of claim 50, wherein the load-restraining device is a pack.

52. The back-mounted load-carrying apparatus of claim 50, wherein the load-restraining device is a cockpit to support and restrain a child.

53. The back-mounted load-carrying apparatus of claim 50, wherein the rigid mounting bracket has a first surface facing the back of a user when the back-mounted load-carry apparatus is carried in its preferred position, the first surface being covered at least partially with padding.

54. The back-mounted load-carrying apparatus of claim 50, wherein the rigid mounting bracket is fabricated of a plastic material.

55. The back-mounted load-carrying apparatus of claim 50, wherein the at least one shaft is biased in the extended position.

56. The back-mounted load-carrying apparatus of claim 50, wherein:

the biasing mechanism is comprises, v) a knob rotate-ably connected to the rigid mounting bracket and, vi) a torsion spring with two ends, one end restrained at a first connection location on the rigid mounting bracket, and the other end restrained at a second connection location on the knob;

the at least one shaft is coupled with the knob;

whereby the knob may be rotated by a user to pull the at lease one shaft into the retracted position, freeing the rigid mounting bracket to slide along the rigid frame.

57. The back-mounted load-carrying apparatus of claim 50, wherein the rigid frame comprises at least one columnar-member, the columnar member being substantially vertically orientated when a user is carrying the back-mounted load carrying apparatus in an intended manner.

58. The back-mounted load-carrying apparatus of claim 57, wherein the at least one columnar member is tubular.

59. The back-mounted load-carrying apparatus of claim 50, wherein the locking mechanism is operable by a user to lock and unlock the waist belt assembly while the user is wearing the back-mounted load-carrying apparatus in the intended manner.

60. The back-mounted load-carrying apparatus of claim 59, wherein the locking mechanism is operable using a single hand of the user while the user is wearing the back-mounted load-carrying apparatus in the intended manner.

61. The back-mounted load-carrying apparatus of claim 60, wherein the waist belt assembly may be further freely moved between the plurality of positions using the single hand of the user when the locking mechanism is unlocked and while the user is wearing the back-mounted load-carrying apparatus in the intended manner.

62. The back-mounted load-carrying apparatus of claim 50, wherein the waist belt further includes two hip load transfer plates and two hinges, each hinge of the two hinges rotate-ably attaching one of the two hip load transfer plates to the rigid mounting bracket.

63. The back-mounted load-carrying apparatus of claim 62, wherein the two hinges comprise living hinges.

64. The back-mounted load-carrying apparatus of claim 62, wherein:

the hip-load transfer plates are substantially rigid to loads applied in a first direction and substantially resilient to loads applied in a second direction, the second direction being approximately perpendicular to the first direction; and whereby when the back-mounted load carrying apparatus is worn and the waist belt secured, the plates approximately conform to a user's body and act to transfer at least a portion of the weight of the back-mounted load carrying apparatus to the user's hips.

65. The back-mounted load-carrying apparatus of claim 64, wherein the hip-load transfer plates are substantially vertically orientated.

66. The back-mounted load-carrying apparatus of claim 64, wherein the hip-load transfer plates are canted relative to a vertical axis of the back-mounted load-carrying apparatus.

67. The back-mounted load-carrying apparatus of claim 66, wherein the hip-load transfer plates are canted inward towards each other.

68. A back-mounted load-carrying apparatus comprising:

(a) a rigid frame comprising two spaced vertically orientated columnar members;

(b) at least one shoulder strap;

(c) a load restraining device, the load restraining device configured to secure a load to the back-mounted load carrying apparatus; and (d) a waist belt assembly adjustably connected to the rigid frame permitting the assembly to be freely moved between a plurality of generally vertical positions along the rigid frame, the waist belt assembly including a locking mechanism to secure the adjustable waist belt assembly in any one of the plurality of generally vertical positions.

69. The back-mounted load-carrying apparatus of claim 68, wherein the locking mechanism is operable to release the waist belt assembly from the secured position and permit free movement of the waist belt assembly between the plurality of vertical positions while a user is wearing the back-mounted load carrying apparatus.

70. The back-mounted load-carrying apparatus of claim 68, wherein the rigid frame comprises at least one vertically orientated columnar member.

71. The back-mounted load-carrying apparatus of claim 68, wherein the load-restraining device is a pack.

72. The back-mounted load-carrying apparatus of claim 68, wherein the load-restraining device is a child restraint device.

73. The back-mounted load carrying apparatus of claim 68, wherein:

(a) the locking mechanism comprises a pair of opposed shafts, movable between an extended position and a retracted position;

(b) the two spaced columnar members have formed in each a plurality of openings, each of the plurality of openings capable of receiving a shaft of the pair of shafts when the shaft is in a extended position.

74. The back-mounted load carrying apparatus of claim 68, wherein:

(a) the locking mechanism comprises at least one shaft, movable from an extended position and a retracted position; and (b) the at least one columnar member has formed therein a plurality of openings, each of the plurality of openings capable of receiving the at least one shaft when the shaft is in a extended position.

75. The back-mounted load-carrying apparatus of claim 74, wherein the at least one shaft is biased in the extended position.

76. The back-mounted load-carrying apparatus of claim 68, wherein the waist belt assembly further includes two hip load transfer plates and two hinges, each hinge of the two hinges rotate-ably attaching one of the two hip load transfer plates to the rigid mounting bracket.

77. The back-mounted load-carrying apparatus of claim 76, wherein:

the hip-load transfer plates are substantially rigid to loads applied in a first direction and substantially resilient to loads applied in a second direction approximately perpendicular to the first direction;

whereby when the back-mounted load carrying apparatus is worn and the waist belt secured, the plates approximately conform to the user's body and act to transfer at least a portion of the weight of the back-mounted load carrying apparatus to the user's hips.

78. The back-mounted load-carrying apparatus of claim 77, wherein the hip-load transfer plates are substantially vertically orientated.

79. The back-mounted load-carrying apparatus of claim 76, wherein the hip-load transfer plates are canted relative to a vertical axis of the back-mounted load carrying apparatus.

80. The back-mounted load-carrying apparatus of claim 79, wherein the hip-load transfer plates are canted inward.

81. A back-mounted load-carrying apparatus comprising:

(a) a rigid frame;

(b) at least one shoulder strap;

(c) a load restraining device, the load restraining device configured to secure a load to the back-mounted load carrying apparatus; and (d) a waist belt assembly adjustably connected to the rigid frame permitting the assembly to be freely moved between a plurality of generally vertical positions along the rigid frame, the waist belt assembly including a locking mechanism to secure the adjustable waist belt assembly in any one of the plurality of generally vertical positions, the waist belt assembly further including two hip load transfer plates and two hinges, each hinge of the two hinges rotate-ably attaching one of the two hip load transfer plates to the rigid mounting bracket.

82. The back-mounted load-carrying apparatus of claim 81, wherein the locking mechanism is operable to release the waist belt assembly from the secured position and permit free movement of the waist belt assembly between the plurality of vertical positions while a user is wearing the back-mounted load carrying apparatus.

83. The back-mounted load-carrying apparatus of claim 81, wherein the rigid frame comprises at least one vertically orientated columnar member.

84. The back-mounted load-carrying apparatus of claim 81 wherein the load-restraining device is a pack.

85. The back-mounted load-carrying apparatus of claim 81, wherein the load-restraining device is a child restraint device.

86. The back-mounted load carrying apparatus of claim 81, wherein:

(a) the locking mechanism comprises at least one shaft, movable from an extended position and a retracted position; and (b) the at least one columnar-member has formed therein a plurality of openings, each of the plurality of openings capable of receiving the at least one shaft when the shaft is in a extended position.

87. The back-mounted load-carrying apparatus of claim 86, wherein the at least one shaft is biased in the extended position.

88. The back-mounted load-carrying apparatus of claim 81, wherein the rigid frame comprises two spaced vertically orientated columnar members.

89. The back-mounted load carrying apparatus of claim 88, wherein:

(a) the locking mechanism comprises a pair of opposed shafts, movable between an extended position and a retracted position;

(b) the two spaced columnar members have formed in each a plurality of openings, each of the plurality of openings capable of receiving a shaft of the pair of shafts when the shaft is in a extended position.

90. The back-mounted load-carrying apparatus of claim 81, wherein:

the hip-load transfer plates are substantially rigid to loads applied in a first direction and substantially resilient to loads applied in a second direction approximately perpendicular to the first direction;

whereby when the back-mounted load carrying apparatus is worn and the waist belt secured, the plates approximately conform to the user's body and act to transfer at least a portion of the weight of the back-mounted load carrying apparatus to the user's hips.

91. The back-mounted load-carrying apparatus of claim 90, wherein the hip-load transfer plates are substantially vertically orientated.

92. The back-mounted load-carrying apparatus of claim 81, wherein the hip-load transfer plates are canted relative to a vertical axis of the back-mounted load carrying apparatus.

93. The back-mounted load-carrying apparatus of claim 92, wherein the hip-load transfer plates are canted inward.

94. A back-mounted load-carrying apparatus comprising:

(a) a rigid frame;

(b) at least one shoulder strap;

(c) a load restraining device, the load restraining device configured to secure a load to the back-mounted load carrying apparatus; and (d) a waist belt assembly, the waist belt assembly including, i) a bracket, the bracket connecting the waist belt assembly to the rigid frame ii) a pair of hip-load transfer members that are substantially rigid to loads applied in at least one direction, iii) a pair of living hinges, the living hinges rotate-ably connecting the pair of hip load transfer members to the bracket, and vi) a belt and buckle configuration, the belt and buckle configuration secured to at least one of the hip-load transfer members and the bracket.

95. The back-mounted load-carrying apparatus of claim 94, wherein the load-restraining device is a pack.

96. The back-mounted load-carrying apparatus of claim 94, wherein the load-restraining device is a child restraint device.

97. The back-mounted load-carrying apparatus of claim 94, wherein the bracket is adjustably connected to the frame permitting the vertical position of the bracket relative to the rigid frame to be varied.

98. The back-mounted load-carrying apparatus of claim 97, wherein the waist belt assembly further comprises a locking mechanism attached with the bracket to lock the waist belt at a specified position on the rigid frame.

99. The back-mounted load-carrying apparatus of claim 94, wherein the pair of hip-load transfer members are a pair of plates, each plate having a face wherein each plate is flexible to loads applied to the face, whereby when the back-mounted load-carrying apparatus is worn and the waist belt secured, the plates approximately conform to a user's body.

100. The back-mounted load-carrying apparatus of claim 99, wherein the pair of plates are substantially vertically orientated.

101. The back-mounted load-carrying apparatus of claim 100, wherein the pair of plates are canted relative to a vertical axis of the back-mounted load carrying apparatus.

102. The back-mounted load-carrying apparatus of claim 101, wherein the pair of plates are canted inward.

* * * * *